US006487766B2

(12) United States Patent
Sillene

(10) Patent No.: US 6,487,766 B2
(45) **Date of Patent: *Dec. 3, 2002**

(54) MANUFACTURING PROCESS FOR CONTAINER INCLUDING A HEAT EXCHANGE UNIT AS AN INTEGRAL PART THEREOF

(75) Inventor: Mark Sillene, Beds (GB)

(73) Assignee: Chill-Can International, Inc., Laguna Niguel, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/248,163

(22) Filed: Feb. 10, 1999

(65) Prior Publication Data

US 2001/0005931 A1 Jul. 5, 2001

(51) Int. Cl.[7] ..... B21D 39/00; B21D 39/03
(52) U.S. Cl. ..... 29/509; 29/505; 29/428
(58) Field of Search ..... 29/505, 509, 428, 29/34 R; 62/29.4, 60, 480, 481, 457.9; 220/601, 23.87, 23.9; 72/324

(56) References Cited

U.S. PATENT DOCUMENTS

| | | | | | |
|---|---|---|---|---|---|
| 4,049,158 | A | * | 9/1977 | Io et al. | 222/95 |
| 4,387,833 | A | * | 6/1983 | Venus, Jr. | 222/95 |
| 4,679,407 | A | * | 7/1987 | Kim et al. | 62/294 |
| 5,214,933 | A | * | 6/1993 | Aitchison et al. | 62/294 |
| 5,655,384 | A | * | 8/1997 | Joslin, Jr. | 62/294 |
| 5,979,164 | A | * | 11/1999 | Scudder et al. | 62/4 |
| 6,103,280 | A | * | 8/2000 | Molzahn et al. | 426/109 |
| 6,105,384 | A | * | 8/2000 | Joseph | 62/293 |
| 6,253,440 | B1 | * | 7/2001 | Chen | 29/509 |

* cited by examiner

*Primary Examiner*—David P. Bryant
*Assistant Examiner*—John C. Hong
(74) *Attorney, Agent, or Firm*—Fulbright & Jaworski L.L.P.

(57) ABSTRACT

A method of manufacturing a container for receiving a food or beverage and including a heat exchange unit as an integral part thereof. The container is formed with an opening in a closed end thereof which opening is mated with a heat exchange unit containing an adsorbent material and is permanently secured thereto along with a valve and valve cap. The heat exchange unit is charged with a medium which, when activated, will heat or cool the food or beverage in the container depending upon whether the heat exchange unit is exothermic or endothermic.

26 Claims, 4 Drawing Sheets

MANUFACTURING PROCESS FOR CONTAINER INCLUDING A HEAT EXCHANGE UNIT AS AN INTEGRAL PART THEREOF

BACKGROUND OF THE INVENTION

1. Field of the Invention

The present invention relates generally to containers having a heat exchange unit as an integral part thereof for cooling or heating food or beverage disposed within the container and in contact with the heat exchange unit. More specifically, the present invention is directed to the process of manufacturing such a container.

2. Description of the Art

There exists many portable containers which are adapted to receive food or beverage therein and which also include as an integral part thereof a heat exchange unit. The heat exchange unit may contain a vessel which is charged with materials which will provide an endothermic or an exothermic reaction to either cool or heat the food or beverage disposed within the container and in contact with the outer surface of the heat exchange unit. These prior art containers take many forms and in many instances the container must be radically modified from that normally used to contain the food or beverage where no heat exchange unit is utilized. The purpose of the present invention is to provide a process of manufacturing a container which does not radically alter the traditional container and which allows the utilization of the standard packaging equipment normally utilized in the industry relating to the particular food or beverage product.

SUMMARY OF THE INVENTION

The method of manufacturing a food or beverage container, including the heat exchange unit in accordance with principles of the present invention, comprises the steps of providing a container having one end defining an opening therein, providing a heat exchange unit having an open end and a closed end, inserting the heat exchange into the container and securing the open end of the heat exchange unit to the container at the opening which is provided in the one end thereof.

DETAILED DESCRIPTION OF THE INVENTION

There has been a long felt need in the industry to provide portable containers capable of in situ cooling or heating of the contents of the container without the necessity of employing outside agencies such as a refrigerator system or a stove, microwave or the like. Examples of devices which have been generated to satisfy this need are illustrated in U.S. Pat. Nos. 4,802,343 and 566,022. The art is replete with various types of container designs which are capable of incorporating devices that will provide endothermic or exothermic reactions to cool or heat respectively the contents of the container. Those cited above are merely representative of such container designs. As is illustrated in the two patents set forth above, the structure incorporated for accomplishing heating or cooling necessitates the change of the manufacturing process to incorporate the structure to provide the endothermic or exothermic reactions needed.

In all cases the container which is to be employed must include some type of device which when triggered will activate the endothermic or exothermic reaction to accomplish the desired cooling or heating of the contents of the container. It is desirable that this device be affixed along with the element containing the materials to provide the endothermic or exothermic reaction to a container which can be utilized in the already existing production linesutilized by companies which are packaging foods or beverages. It is therefore, an important aspect of the present invention that the process as disclosed utilizes food or beverage containers which can be utilized in the standard packaging machinery lines currently in existence. The process and machinery need be modified only slightly to receive the element (typically a heat exchange unit) within the container and affix it to the container in such a manner that a valve or similar triggering device is readily accessible to the consumer for activation as desired to cool or heat the contents of the container.

Although the present invention is equally applicable to structures which heat the contents of the container, as well as to those which cool the contents of the containers, for ease of illustration and description, the remaining discussion will be directed to a structure which is designed for cooling the contents of the container, specifically to beverage cans and the like. In such devices the heat exchange unit (HEU) is affixed permanently to one end of the container and is charged with materials which, when activated, will cool the beverage contained in the container to a temperature between 35° C. and 45° F. within a short time.

Figure 1:
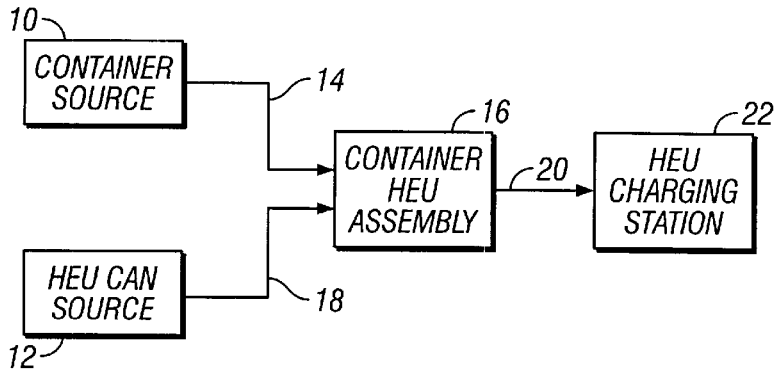
FIG. 1 is a schematic diagram illustrating an assembly line for practicing the method of the present invention.

Referring now to FIG. 1, there is illustrated schematically the manufacturing process in accordance with the principles of the present invention. As is therein shown, a source of containers 10 for the food or beverage is provided. There is also provided an HEU can source 12. The container source provides a container which is traditionally used for whatever the food or beverage is that is to be packaged. As above indicated, in the case of beverages it will be the traditional can type of structure normally utilized. The can will typically be one which has the top thereof open for later insertion of the beverage therein but the bottom will be closed as is normally the case. Prior to becoming available as a container for utilization in the manufacturing process of the present invention, an appropriate opening must be provided in the bottom of the container. That opening is utilized to mate with the HEU can which would come from the source 12. It will thus be recognized that the container from the source 10 having an opening in the bottom thereof, will be transported along a conveyor or the like 14 to the container-HEU assembly station 16. The can which is utilized for the HEU is transported along the conveyor or similar such structure 18 to the container HEU assembly station 16. The HEU can will be a can that will fit inside the beverage can and has an open upper portion and is ready to receive the refrigerant. Alternatively of course, if the HEU is one which provides an exothermic reaction, then that HEU can will be ready to receive the appropriate chemicals for providing the exothermic reaction or alternatively will have such chemicals already placed therein depending upon the appropriate structure in the application involved.

At the container HEU assembly station 16, the open end of the HEU can is mated with the opening in the bottom of the container and the two are secured together, typically by being permanently attached by any means known to the art. In accordance with a preferred embodiment of the invention, an appropriate triggering device is also mated with the open end of the HEU and that triggering device is also simultaneously secured to the beverage can and the HEU. Typically the triggering device will be a plunger, button, pull tab or the like depending upon the contents of the HEU and whether an endothermic or exothermic reaction is to take place. In accordance with a preferred embodiment of the present invention where the container is one which provides an endothermic reaction and which contains a refrigerant gas under pressure, the triggering device will be a valve which may be depressed by the consumer to activate the HEU. Under such circumstances, the valve is disposed within a valve cup which is inserted into the open end of the beverage can and the open end of the HEU and then, through a crimping operation, the three are permanently secured together.

Once the HEU and the container are permanently secured together with the appropriate triggering device, they are transported by the conveyor or other similar structure 20 to the HEU charging station 22. In this position, the HEU is charged with the appropriate materials which will provide the endothermic or exothermic reaction required by the particular application and the food or beverage housed within the container. As indicated above, if an endothermic reaction is involved, then the HEU may be charged with a gaseous material under pressure and under some circumstances liquified. When the gas is released by depressing the valve, it will transfer the heat contained within the beverage to the gas as it escapes and is allowed to enter the atmosphere. Under these circumstances, the charging of the HEU with the gaseous material is typically done by inserting the material through the valve which has been activated to be opened by an appropriate fixture for that purpose. Obviously, when the gas has been inserted and the HEU has been fully charged to the desired pressure and volume of material, the valve will be allowed to close thereby trapping the gaseous material internally of the HEU can. After such has occurred a protective cover will be placed over the plunger on the valve to keep it from becoming accidentally activated during transport or handling of the assembled container and HEU. Once the HEU has been charged, the container with the fully charged HEU is then provided to the packaging entity which will place the desired food or beverage therein in such a manner that it is within the container and surrounds the outer surface of the HEU. An appropriate cap will then be placed over the open end of the container and sealed thereto in accordance with the standard procedures used in the art. As will be recognized by those skilled in the art, through the utilization of this process a container having the charged HEU therein is provided which to the consumer will appear to be the same type of container as the consumer normally finds when purchasing the desired food or beverage under normal circumstances. However, as a result of the inclusion of the charged HEU, the consumer may cool or heat the contents of the container by activating the trigger device, such for example as the plunger or the valve when the HEU is an endothermic device.

Figure 2:
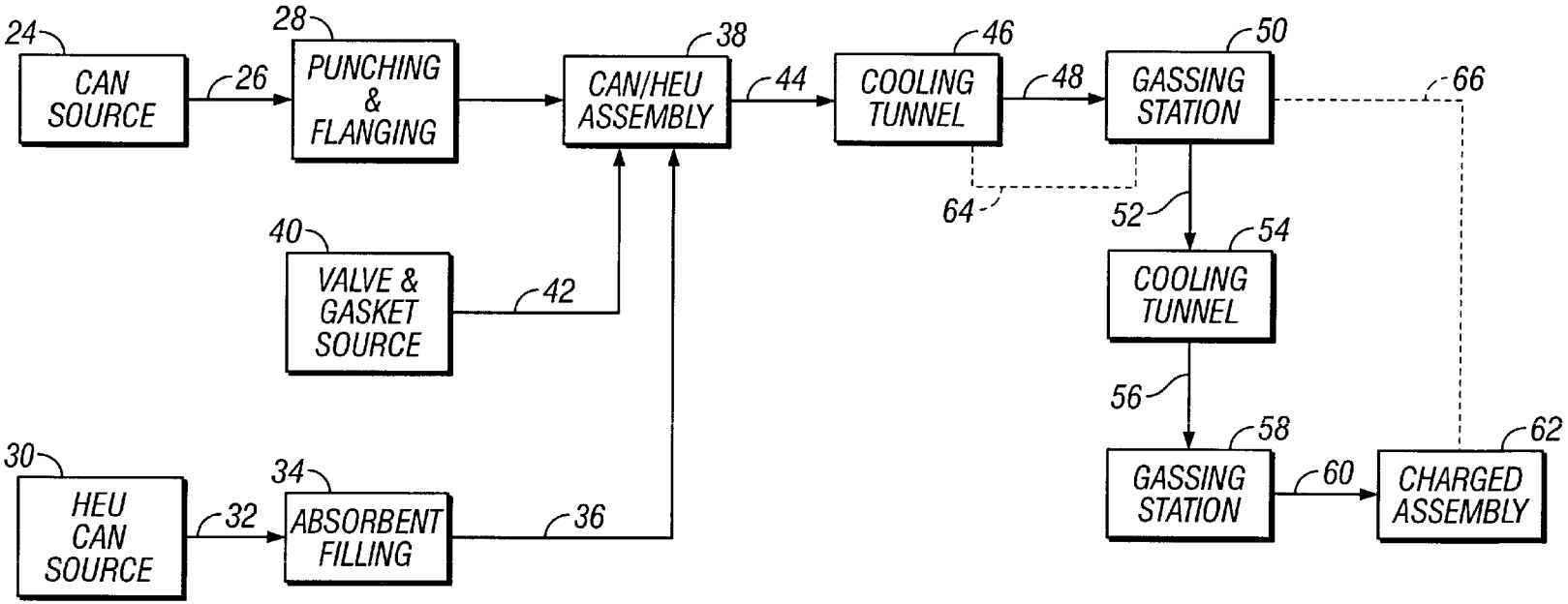
FIG. 2 is a more detailed schematic representation of an assembly line for manufacturing a container having a heat exchange unit therein for cooling the contents of the container.

Referring now more particularly to FIG. 2, a more detailed schematic diagram has been provided of a manufacturing process line wherein the device is an endothermic device used to cool the contents of the container and more particularly where the container is a beverage can and an appropriate beverage is to be inserted into the can after the HEU has been fully charged. As is illustrated in FIG. 2, there is provided a can source 24 which will contain a supply of beverage cans which will be the traditional beverage can with the top end open since there will be no beverage therein and the top must remain open for filling the can with the beverage when the process of the present invention has been completed. The cans from the source 24 travel along an appropriate conveyor belt or the like 26 to a punching and flanging station 28. The punching and flanging station is utilized to provide an opening in the bottom of the can and to thereafter produce a flange around the opening provided in the bottom of the can which may be used during the can HEU assembly process. Hereafter, more detailed discussion of the punching and flanging operation will be provided. There is also provided an HEU can source 30 which contains a source of containers utilized as an HEU in the self-chilling beverage can industry. These cans have an open top and a closed bottom and are smaller than the beverage can from the source 24 so as to be receivable therein while leaving sufficient space to accommodate the beverage to be inserted later. The HEU cans will travel along an appropriate conveyor or the like 32 to an adsorbent filling station 34. The adsorbent filing station is utilized in accordance with one preferred embodiment of the present invention, where the endothermic reaction is provided by the utilization of an adsorbent material which is placed within the HEU can which, as will described more fully below, later is caused to adsorb carbon dioxide which is retained and then upon release provides the desired cooling function. In accordance with a preferred embodiment of the present invention, the adsorbent utilized will be carbon particles. These carbon particles will be inserted into the HEU can. This insertion process can take many forms. For example, the particles of activated charcoal of any desired sieve size may be simply placed into the open container, which will have the desired configuration at its open end or neck to mate with the punched and flanged opening in the can for assembly as more fully described below. Alternatively, the carbon particles may be inserted into the HEU can by extrusion, transfer molding, the utilization of intermediate heat transfer members such as discs, wafers, or the like which will provide an appropriate compaction of the carbon particles to a density which will optimize the adsorption of the carbon dioxide. The open end of the HEU can may be necked inwardly to mate with the punched and flanged open end of the beverage can subsequent to the HEU can being filled with the adsorbent material.

In any event, after the HEU can has been appropriately filled with the adsorbent material, it is then transported by the conveyor 36 to the can/HEU assembly station 38. Also transported to the assembly station 38 will be an appropriate valve and a gasket which is utilized in the assembly process. The valve and gasket are provided from a source 40 thereof. The valve and gasket are transported by an appropriate conveyor or the like 42 to the can/HEU assembly station 38. In assembly of the HEU and affixing it to the beverage can an appropriate gasket formed of elastomeric material is placed over the open end of the HEU which contains the adsorbent material therein. An inspection is performed to guarantee that the gasket is in fact seated properly upon the open end of the HEU. Subsequent thereto, the HEU open end having the gasket thereon is mated with the flange which surrounds the opening punched into the closed end of the can at the punching and flanging station 28. The valve and valve cup is then inserted into the opening provided in the bottom of the can and simultaneously into the opening in the HEU can and by way of a crimping process the valve HEU and beverage can are permanently secured together in a fashion so that an appropriate seal is formed between the HEU, the valve cup and the can to prevent any leakage of the beverage which is later to be placed into the beverage can.

Subsequent to the assembly of the beverage can and the HEU, this assembly is transported by way of the conveyor belt or the like 44 to a cooling tunnel 46. The purpose of the cooling tunnel is to cool the carbon adsorbent to a relatively low temperature. Typically, the cooling tunnel will be filled with a cryogenic gas such as liquid nitrogen or the like to throughly cool the entire assembly but particularly the activated carbon particles which function as an adsorbent in the HEU can. If such cooling does not take place, then the amount of carbon dioxide which can be adsorbed by the carbon particles is limited. In addition, as carbon dioxide is forced under pressure into the interior of the HEU can for adsorption an exothermic reaction occurs generating a substantial amount of heat which will radiate from the HEU. As the heat is generated from the carbon dioxide adsorption process, the carbon naturally will heat up and as it heats up, again the amount of carbon dioxide which it can adsorb decreases. As a result, it is necessary that the carbon particles be cooled to as low a temperature as possible within a reasonable period of time. Therefore, the can HEU assembly with the carbon particles therein is passed through the cooling tunnel and from there moves along a conveyor or the like 48 to a gassing station 50. At the gassing station 50, the valve is depressed and carbon dioxide is inserted into the HEU until a predetermined pressure of approximately 25 bars is reached. Typically at this point, there will not be sufficient carbon dioxide adsorbed by the carbon to cool the beverage contained within the can to the desired temperature for consumption. This results because of the increase in the heat of the carbon during the gassing thus limiting the volume of carbon dioxide. As a result, when the pressure of the carbon dioxide has reached the predetermined amount, the gassing operation is stopped and the partially gassed can HEU assembly is transported along the conveyor 52 to a second cooling tunnel 54 where the cooling process is repeated as above described. Subsequent to passing through the cooling tunnel 54, the now cooled and partially gassed HEU can assembly is transported along the conveyor 56 to a second gassing station 58 where the gassing process is again performed. Gassing continues until the appropriate volume of carbon dioxide is adsorbed by the activated carbon particles contained within the HEU. When such occurs, the gassing operation is stopped and the now fully charged HEU/can assembly is transported by an appropriate conveyor 60 to a charged assembly gathering station 62.

Although two cooling tunnels and two gassing stations are illustrated in FIG. 2, it should be understood that the partially gassed HEU can assembly may be passed back through the first cooling tunnel 46 and such is indicated by the dashed line 64. Thus, if sufficient volume is available and the second pass through the cooling tunnel can be designed so as to not interfere with the original can/HEU assemblies passing into the cooling tunnel, then the second iteration of the cooling and gassing can be accomplished by the original cooling tunnel 46 and gassing station 50. If such occurs, then the charged assembly collection station 62 would be positioned to receive the fully charged HEU can assembly as indicated by the second dashed line 66 from the gassing station 50 to the collection station 62.

It has also been discovered that at the time of completion of the gassing of the HEU the pressure in the HEU can should be raised to the maximum allowed by the head space above the carbon within the HEU can. The total amount of carbon dioxide pressure will be determined by the shape and material of the beverage and HEU can as well as the valve cup. At the present time the maximum pressure will be approximately 25 bars. When the valve is released at the conclusion of the gassing step, the carbon dioxide trapped in the head space at this elevated temperature will gradually migrate into the carbon particles and be adsorbed during storage of the can/HEU assembly thereby increasing the cooling capability of the completed assembly.

Figure 3:
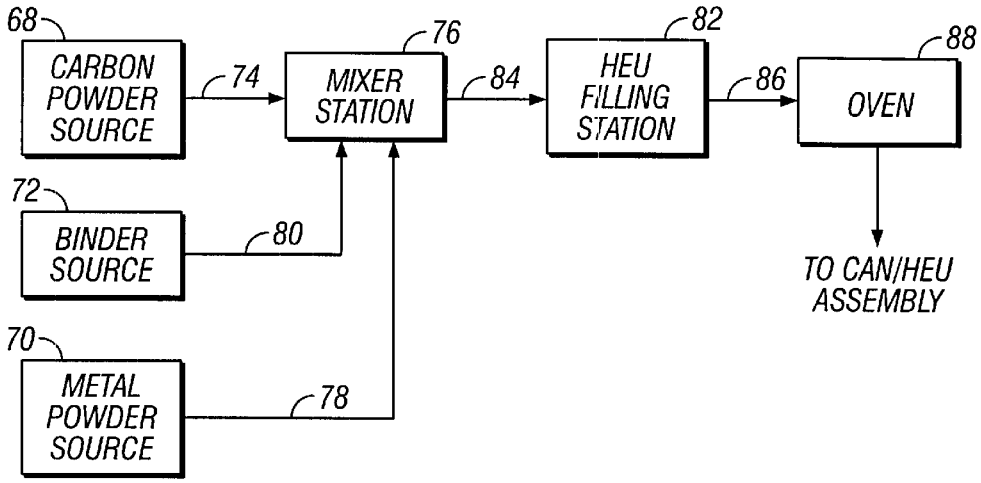
FIG. 3 is a schematic diagram of an assembly process of one portion of a assembly line as disclosed in FIG. 2.

By reference to FIG. 3, there is illustrated in more detail the adsorbent filling operation wherein the carbon powder is applied to the HEU can. As is shown in FIG. 3, there is provided a source of carbon powder 68, a source of metal powder 70 and a source of binder 72. The carbon powder is transported by way of an appropriate conveyance chute belt, screw, plunger or other mechanism 74 to a mixer station 76. The metal powder is also transported by a conveyance means 78 such as a belt, chute, screw or plunger to the mixer station 76 and the binder is likewise transported by a similar appropriate conveyance mechanism 80 to the mixer station 76. At the mixer station 76, the carbon powder and metal powder are intermixed with an appropriate binder to provide a desired mixture in a form which can be utilized to fill the HEU can. The utilization of the metal powder is to provide an appropriate mix of metallic particles with the activated carbon particles to provide a better heat transfer through the carbon particles, so that the heat of the beverage can be removed and exhausted with the carbon dioxide gas in a shorter period of time through the valve. Although various metallic powder may work well, it has been found that aluminum powder is preferred. Without some type heat transfer mechanism disposed within the carbon particles, it has been found that the heat is not easily transferred through carbon which is traditionally a relatively good insulator. Various types of heat sinks have been utilized but it has been found that an appropriate mixture of the metal powder with the carbon provides an excellent vehicle to transfer the heat from the beverage through the carbon and to the atmosphere. It has been found that the metal powder and the carbon can be combined without a binder and inserted into the HEU can and appropriately compacted with excellent results in cooling the beverage. However, in accordance with one preferred embodiment of the invention, it has been found that with an appropriate amount of binder the resultant mix from the mixer station 76 may be homogeneous and have a viscosity suitable to be extrudable and by that vehicle used to fill the HEU can at the HEU filling station 80. Thus, the transportation as shown by the arrow and lead line 84 may be in the form of an extruder mechanism know to those skilled in the art such as a plunger or screw. It has been found that the combination of binder, metal powder and carbon powder should be such that the melt flow rate of the resulting mix is between 0.1 and 0.2 grams per 10 minutes. The binder may be any well known to the art but is preferably a polymeric material, which will not affect the adsorption capability of the carbon particles. One preferred group of polymeric material is polyolefine thermoplastic material. Alternatively, the binder may be solvent based or water based depending upon the particular application.

If the carbon and metal powders are mixed together and the HEU can is filled, then the thus filled HEU can be passed directly to the can/HEU assembly station 38 as illustrated in FIG. 2. On the other hand, if a binder is utilized, it may be necessary to drive off the residual portions of the binder by subjecting the filled HEU can to heat by transporting it along an appropriate conveyor 86 to an oven 88, where it may reside for a time sufficient to drive off that part of the binder which must be eliminated prior to completing the assembly process.

If the carbon binder and metal powder is mixed at the mixer station 76, as above indicated extrusion may be utilized as indicated at 84 to fill the HEU can. However, there are other processes which may be also utilized to accomplish the filling. Such processing would be the use of a transfer mold, a compression mold, a RAM extrusion of a rod into an HEU shell, a liquid slurry or the like. This step in the process may be performed as an integral part of the process or alternatively performed at a separate site with the resultant stored for later use in the process.

In accordance with one preferred form, the mixer station may have an extrusion mold out of which preforms of the carbon and metal powder are generated. These preforms with the appropriate binder may be subjected to heat in an oven as desired to drive off residual binder and to provide the completed product. Thereafter, the preforms may be inserted into the HEU can at the HEU filling station in various manners to accomplish close thermal coupling with the interior surface of the HEU can to thereby assist in transfer of heat from the beverage through the HEU to the atmosphere as the carbon dioxide is desorbed from the carbon particles.

As above indicated, an appropriate opening surrounded by a flange is provided at the punching and flanging station 28 of the process as schematically illustrated in FIG. 2. A further and more detailed description along with schematic illustrations will be provided to further illustrate and disclose the punching and flanging activity which occurs at the station 28.

Figure 4:
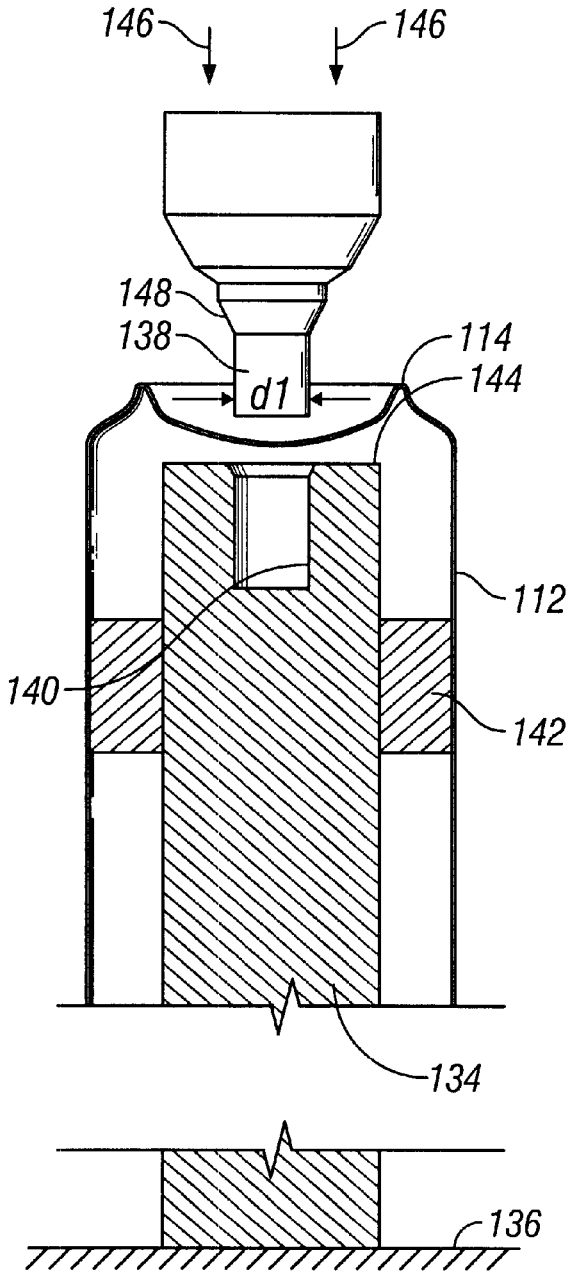
FIG. 4 is a schematic illustration showing apparatus used in the process of forming an opening in a beverage can.
Figure 6:
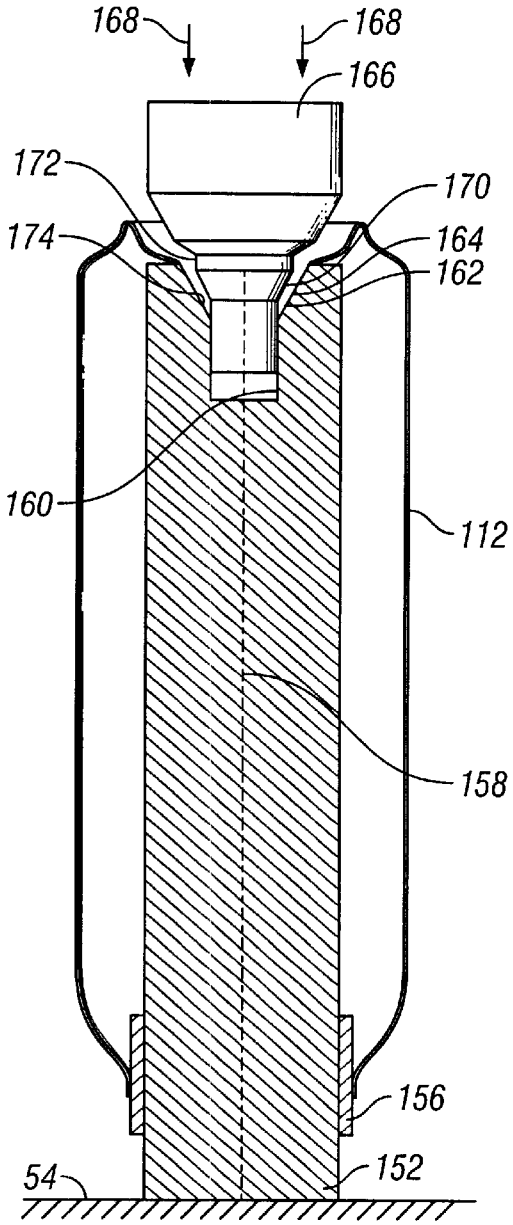
FIG. 6 illustrates an apparatus and process for forming a flange adjacent to the opening in the beverage can.

By referring now to FIGS. 4 and 6 there is shown the apparatus for forming the flange 28 in the bottom of the can. It will be appreciated by those skilled in the art that what is illustrated in FIGS. 4 and 6 are schematic sketches of apparatus to carry out the fabrication methods for forming the flange 128. In actual production and particularly in mass production the equipment will be automated and much more sophisticated than that illustrated in FIGS. 4 and 6. Nonetheless, the principle involved will be the same and therefore the invention is not to be limited by the drawings. As is shown in FIG. 4, there is provided an anvil 134 which rests upon a foundation 136 such that the anvil is well supported and in a position to receive the forces generated by the acceptance of a punch 138. The outer diameter d1 of the punch 138 is substantially the same as the diameter of the bore 140 which is formed in the upper portion of the anvil 134. There will be a sufficient difference between the diameters to permit clearance for the punch 138 to enter the bore 140 without binding.

Figure 5:
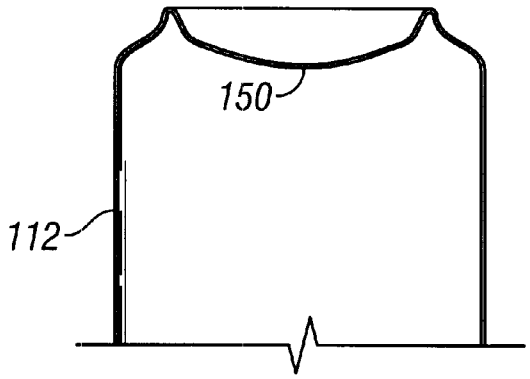
FIG. 5 illustrates the beverage with the opening formed therein.

In order to form the flange 28 some material must first be removed from the bottom 114 of the beverage can. This is accomplished by positioning the beverage can 112 over the anvil 134 with the bottom 114 of the can positioned over the bore 140. The can 112 should be centrally positioned upon the anvil 134 and an appropriate jig such as a spacer 142 may be positioned around the anvil 134. Obviously other devices may be utilized for properly positioning the can 112 centrally with respect to the anvil 134. Once the can has been thusly positioned it is moved downwardly as viewed in FIG. 4 so that the bottom 114 of the can rests securely upon the top surface 144 of the anvil with the center of the bottom 114 positioned directly over the center of the bore 140. Appropriate force is then applied to the punch 138 as illustrated by the arrows 146 to move the punch downwardly and to permit the lower portion thereof to enter the bore 140. It should be noted particularly with respect to FIG. 4 that only the lower portion of the punch 138 which has the diameter d1 which is substantially the same as the inner diameter of the bore 140 can enter the bore 140. Once the outwardly flared portion 148 of the punch 138 reaches the bore 140, further downward movement of the punch 138 is restricted. It will be understood however that the central portion of the bottom 114 of the beverage can 112 is severed from the beverage can by the downward movement of the punch 138. Once this occurs the structure is as illustrated in FIG. 5 wherein the beverage can 112 is illustrated as having an opening or aperture 150 there-through. The aperture 150 is formed by having removed the material by moving the punch 138 from the position shown in FIG. 4 downwardly into the aperture 140.

Obviously, other devices may be used for removing the material from the bottom of the can. For example, a cutting knife edge may be formed on the anvil or the end of the punch with the other surface being flat or defining a slight groove. When the surfaces meet with the can material there between, a predetermined amount of material is severed and removed. The amount of material to be removed is that which is sufficient to allow formation of the flange as described below without fracturing or otherwise destroying the integrity of the remaining portion of the bottom of the can.

Figure 7:
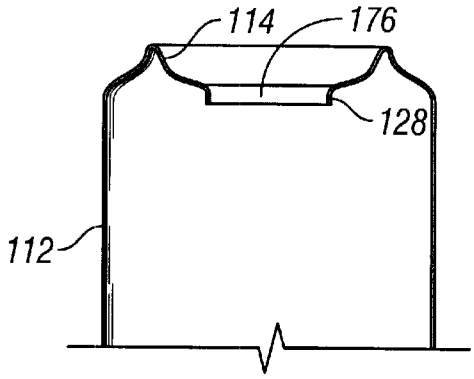
FIG. 7 is a schematic illustration showing an appropriate flange surrounding the opening in the bottom of the beverage can.

By reference now to FIGS. 6 and 7 the second step in forming the flange 128 is illustrated. As is shown in FIG. 6 the beverage can 112 is positioned over an anvil 152 which is formed similarly to that illustrated in FIG. 4 and which also rests upon a foundation 154 for the purposes as above described. The anvil also includes a spacer mechanism 156 to centrally position the can 112 with respect to the center line 158 of the anvil 152. Although the anvil 152 is similar in structure to the anvil 134 and includes a bore 160 therein, it should be noted that the bore tapers outwardly as illustrated at 162 and terminates in a re-entrant bore 164 which has a diameter greater than the bore 160. Likewise, the punch 166, which is propelled downwardly as illustrated by the arrows at 168 also tapers outwardly as illustrated at 170 and terminates adjacent the upper portion of the punch 166 in a vertically disposed region 172. It will be noted by examination, that the punches 138 and 166 are constructed substantially the same, however, the anvils 152 and 134 have a differently shaped bore as above-described. Through utilization of the anvil having the bore with the flare 164 and the straight diameter 160, when the punch 166 is permitted to totally enter the bore 160 to its full limit, the inner edge 174 surrounding the opening 150 in the can 112 is moved downwardly first by the tapered surface 170 and then finally formed by being positioned between the vertical opposed surfaces 172 and 164 on the punch 166 and the anvil 152 respectively. Obviously the outer diameter of the surface 172 of the punch 66 is slightly less then the inner diameter of the vertical surface 164 of the bore 160 by an amount substantially equal to the thickness of the material of the beverage can bottom 114. The end result is as shown in FIG. 7 which clearly illustrates the downwardly directed flange 128 surrounding an opening 176 in the bottom 114 of the can 112. As above indicated the flange 128 is of a sufficient size to receive the elastomeric washer and opening in the HEU can and to receive the valve cup at its inner diameter. Through the utilization of appropriate forming tools the flange 128, the HEU can and the valve cup are formed as by crimping to provide a sealed self-cooling beverage system.

There has thus been disclosed a process for manufacturing a container having an HEU as an integral part thereof which may be utilized to heat or cool contents of the container, depending upon the particular application desired.

What is claimed is:

1. A method of manufacturing a food or beverage container including a heat exchange unit comprising the steps of:

(a) providing a container having a completely closed end and an opposite open end;

(b) forming an opening in said completely closed end of said container;

(c) forming a flange from material of said container around said opening and mating said open end of said heat exchange unit with said flange;

(d) providing a heat exchange unit having an open end and closed end;

(e) inserting the heat exchange unit into the open end of said container; and (f) securing the open end of the heat exchange unit to the container at the opening formed therein.

2. The method as defined in claim 1 wherein said securing step includes providing valve means, inserting the valve means into the open end of the heat exchange unit and into the opening in the container adjacent said flange.

3. The method as defined in claim 2 which includes the further steps of providing a gasket means and positioning the gasket means between the valve and the flange.

4. The method as defined in claim 3 which includes the further step of crimping said valve means by forcing a portion thereof outwardly against the open end of the heat exchange unit thereby sealingly securing said valve means, said container, and said heat exchange unit together.

5. A method of manufacturing a food or beverage container including a heat exchange unit comprising the steps of:

(a) providing a container for receiving said food or beverage and having a completely closed end and an opposite open end;

(b) forming an opening surrounded by a flange in said closed end, said flange extending into the interior of said container;

(c) providing a heat exchange unit having an open end and a closed end;

(d) inserting the heat exchange unit into the container through said opposite open end and mating the open end of said heat exchange unit with said flange; and (e) securing the open end of the heat exchange unit to the container at the flange.

6. The method as defined in claim 5 which includes the further step of inserting particles of an absorbent material into said heat exchange unit prior to inserting the heat exchange unit into the container.

7. The method as defined in claim 6 which further includes inserting an absorbing gas under pressure into said heat exchange unit after securing the heat exchange unit to the container.

8. The method as defined in claim 7 wherein said securing step includes providing valve means, inserting the valve means into the open end of the heat exchange unit and the opening in the container.

9. The method as defined in claim 8 which includes the further steps of providing a gasket means and positioning the gasket means between the valve means and the flange before securing the heat exchange into the container.

10. The method as defined in claim 7 wherein said adsorbent material comprises carbon particles.

11. The method as defined in claim 10 which further includes the step of providing powdered metallic particles, mixing said metallic powdered particles with said carbon particles and inserting the resulting mixture into said heat exchange unit.

12. The method as defined in claim 11 which further includes the steps of providing a binder and forming a viscous mixture of said binder, said carbon particles and said metallic particles.

13. The method as defined in claim 12 which further includes the step of extruding said viscous mixture.

14. The method as defined in claim 12 which further includes the step of producing preforms of said viscous mixture adapted for being received by said heat exchange unit.

15. The method as defined in claim 10 wherein said adsorbing gas is carbon dioxide.

16. The method as defined in claim 15 wherein said adsorbent material comprises carbon particles.

17. The method as defined in claim 16 which further includes the steps providing a binder and forming a viscous mixture of said binder, said carbon and said metallic particles.

18. The method as defined in claim 17 which further includes the step of extruding said viscous mixture.

19. The method as defined in claim 18 which further includes the step of producing preforms of said viscous mixture adapted for being received by said heat exchange unit.

20. The method as defined in claim 16 which includes the further step of cooling said heat exchange unit prior to inserting said carbon dioxide gas into it.

21. The method as defined in claim 20 wherein said cooling step includes first and second cooling steps followed by first and second carbon dioxide inserting steps respectively.

22. The method as defined in claim 16 which includes the further step after inserting said carbon dioxide into said heat exchange unit of increasing pressure in said heat exchange unit to a predetermined level.

23. The method as defined in claim 17 which includes the further step of forming a preform of said extruded mixture adapted to fit within said HEU.

24. A method of manufacturing a food or beverage container including a heat exchange unit comprising steps of:

(a) providing a container for receiving said food or beverage and having a completely closed end and an opposite end;

(b) forming an opening surrounding by a flange in said closed end, said flange extending into the interior of said container;

(c) providing a heat exchange unit having an open end and a closed end;

(d) forming a mixture of carbon absorbent particles and a binder and extruding said mixture;

(e) inserting said extruded mixture into said heat exchange unit;

(f) inserting the heat exchange unit into the container through said opposite open end and mating the open end of said heat exchange unit with said flange;

(g) securing the open end of the heat exchange unit to the container at the flange; and (h) inserting an absorbing gas under pressure into said heat exchange unit after securing said heat exchange unit to said container.

25. A method of manufacturing a food or beverage container including a heat exchange unit comprising the steps of:

(a) providing a container for receiving said food or beverage and having a completely closed end and an opposite open end;

(b) forming an opening surrounded by flange and said closed end, said flange extending into the interior of said container;

(c) providing a heat exchange unit having a open end and a closed end;

(d) providing absorbent carbon particles;

(e) providing powered metallic particles;

(f) mixing said metallic powdered particles with said carbon particles and inserting the resulting mixture into said heat exchange unit;

(g) inserting the heat exchange unit into the container through said opposite end and mating the open end of said heat exchange unit with said flange;

(h) securing the open end of the heat exchange unit to the container at the flange; and (i) inserting an absorbing gas under pressure into said heat exchange unit after securing said heat exchange unit after securing said heat exchange unit to said container.

26. A method of manufacturing a food or beverage container including a heat exchange unit comprising the steps of:

(a) providing a container for receiving said food or beverage and having a completely closed end and an opposite open end;

(b) forming an opening surrounded by flange and said closed end, said flange extending into the interior of said container;

(c) providing a heat exchange unit having a open end and a closed end;

(d) providing absorbent carbon particles;

(e) providing powered metallic particles;

(f) mixing said metallic powdered particles with said carbon particles and inserting the resulting mixture into said heat exchange unit;

(g) inserting the heat exchange unit into the container through said opposite end and mating the open end of said heat exchange unit with said flange;

(h) securing the open end of the heat exchange unit to the container at the flange; and (i) inserting carbon dioxide under pressure into said heat exchange unit after securing said heat exchange unit to said container.

* * * * *